US007467948B2

(12) United States Patent
Lindberg et al.

(10) Patent No.: US 7,467,948 B2
(45) Date of Patent: Dec. 23, 2008

(54) MAGNETIC CONNECTOR FOR MOBILE ELECTRONIC DEVICES

(75) Inventors: Phillip Lindberg, Helsinki (FI); Sameer Shirgaonkar, London (GB); Kati Björninen, Helsinki (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/450,563

(22) Filed: Jun. 8, 2006

(65) Prior Publication Data

US 2007/0287302 A1 Dec. 13, 2007

(51) Int. Cl.
*H01R 11/30* (2006.01)

(52) U.S. Cl. ..... 439/38

(58) Field of Classification Search ..... 439/38, 439/39, 40, 505, 519; 361/733
See application file for complete search history.

(56) References Cited

U.S. PATENT DOCUMENTS

| | | | | |
|---|---|---|---|---|
| 3,363,214 | A * | 1/1968 | Wright | 439/39 |
| 3,720,874 | A * | 3/1973 | Gorcik et al. | 455/90.3 |
| 3,810,258 | A * | 5/1974 | Mathauser | 439/39 |
| 5,382,167 | A * | 1/1995 | Janson, Jr. | 439/38 |
| 5,418,686 | A * | 5/1995 | Dieken et al. | 361/733 |
| 5,941,729 | A * | 8/1999 | Sri-Jayantha | 439/505 |
| 6,478,614 | B1 * | 11/2002 | De'Longhi | 439/519 |
| 6,561,815 | B1 * | 5/2003 | Schmidt | 439/38 |
| 6,966,781 | B1 * | 11/2005 | Bullinger et al. | 439/38 |
| 2002/0054686 | A1 | 5/2002 | Tabata et al. | 381/86 |
| 2007/0072443 | A1 * | 3/2007 | Rohrbach et al. | 439/39 |

FOREIGN PATENT DOCUMENTS

| | | | |
|---|---|---|---|
| DE | 200 09 514 | U1 | 11/2000 |
| DE | 101 48 329 | A1 | 4/2003 |
| DE | 101 61 709 | A1 | 6/2003 |
| EP | 1 577 984 | A1 | 9/2005 |

* cited by examiner

*Primary Examiner*—Chandrika Prasad
(74) *Attorney, Agent, or Firm*—Harrington & Smith, PC

(57) ABSTRACT

A magnetic connector for connecting various cables to a mobile electronic device includes a connector part in the mobile electronic device and a connector part attached to the cable. One of the connector parts includes a permanent magnet and the other connector part includes magnetic material or another magnet. The attractive magnetic force between the permanent magnet or the other magnet and the magnetic material keeps the connector parts into engagement. The magnets may themselves form the electrical contacts. The connector parts can also include magnetically operated switches.

12 Claims, 5 Drawing Sheets

MAGNETIC CONNECTOR FOR MOBILE ELECTRONIC DEVICES

FIELD OF THE INVENTION

The present invention relates to connectors for connecting a cable to a mobile electronic device, in particular to releasable connectors.

BACKGROUND OF THE INVENTION

Mobile electronic devices, such as mobile phones, are usually provided with a plurality of connectors to allow the mobile phone to be connected to a cable of a battery charger, to a cable of earphones, or to a cable for connecting the mobile phone to a personal computer. Typically, there are several closely spaced separate connectors located in an area of the phone. The close spacing that is required for keeping the mobile devices increases the chance that the user tries to connect a cable to the wrong connector on the phone. Further, many of the connectors that are presently used in mobile phones are similar to jacks or plugs and constitute openings in the phone that can collect dust and dirt. In most of the connector types used, the engagement between the connecting parts is ensured by a snap connection. In other type of connectors to the engagement between the connecting parts is ensured by the friction effect. In common for all these engagement ensuring means is the fact that the engagement is not broken when the cable is pulled because the light mobile device will simply follow the cable. For example when a user has put his phone on a desk and walks away wearing his earphones this will cause the phone to be dragged from the desk and the phone will possibly get damaged by the impact that follows the fall from the desk.

DISCLOSURE OF THE INVENTION

On this background, it is an object of the present invention to provide a connector for connecting a cable to a mobile electronic device that overcomes or at least reduces the disadvantages associated with the conventional connectors described above.

This object is achieved by providing a connector for electrically and mechanically connecting a cable to a mobile electronic device comprising a first connector part disposed at the end of the cable and a second connector part disposed at the mobile electric device, said first and/or said second connector part including a magnet that is magnetically attracted to magnetic material disposed on the other connector such that the magnetic force generated between the magnet and the magnetic material or between the two magnets is utilized for bringing the first connector and second connector into engagement with each other thereby establishing an electrical connection between the cable and the mobile electrical device.

The magnetically established mechanical connection can be disengaged with relatively low forces, thereby ensuring that the mobile electronic device will not be dragged away when the cable is pulled. Thus, when the user forgets to disengage his earphones or his battery charger and walks away the connection between the respective cable and the mobile electronic device will be broken without the mobile electronic device being dragged from its place, or without excessive force is being applied to the cable and the electronic device.

The connector may be constructed such that the electrical connection is established by the magnet touching on the magnetic material. Thus, there is no need for contacts send the magnets themselves serve as contacts.

The second connector part may include a magnetically activated switch that assumes one condition when the first connector part is connected to the second connector part and another position when the first connector part is not connected to the second connector part. Preferably, an electrical connection between the electronic device and the cable can only be established in the position that the magnetically activated switch assumes when the first connector part is connected to the second connector part.

The second connector part can also connect to a third connector part and when said second and/or said third connector part include a magnet that is magnetically attractive to magnetic material disposed on the other connector part.

Preferably, a first electric routing is established when said second connector part is connected to said first connector part and wherein a second electric routing different from the first electric routing is established when said second connector part is connected to set third connector part. The different routing may be established by a magnetic switch connected to said second connector part and said magnetic switch assuming the first position when said first connector part is connected to said second connector part and said magnetic switch assuming a second position when said second connector part is connected to set third connector part.

It is another object of the present invention to provide a mobile electronic device comprising a first connector of the type described above.

The mobile electronic device may comprise a second connector of the type described above. In this case the disposition of the polarity of the magnets is such that the first connector part of the first connector is repulsed by the second connector part of the second connector. Preferably, the disposition of the polarity of the magnets is also such that the first connector part of the second connector is repulsed by the second connector part of the first connector.

Further objects, features, advantages and properties of the connector and mobile at charming to device according to the invention will become apparent from the detailed description.

BRIEF DESCRIPTION OF THE DRAWINGS

In the following detailed portion of the present description, the invention will be explained in more detail with reference to the exemplary embodiments shown in the drawings, in which.

DETAILED DESCRIPTION OF PREFERRED EMBODIMENTS

In the following detailed description, the connector and the mobile electronic device according to the invention in the form of a mobile telephone.

Figure 1:
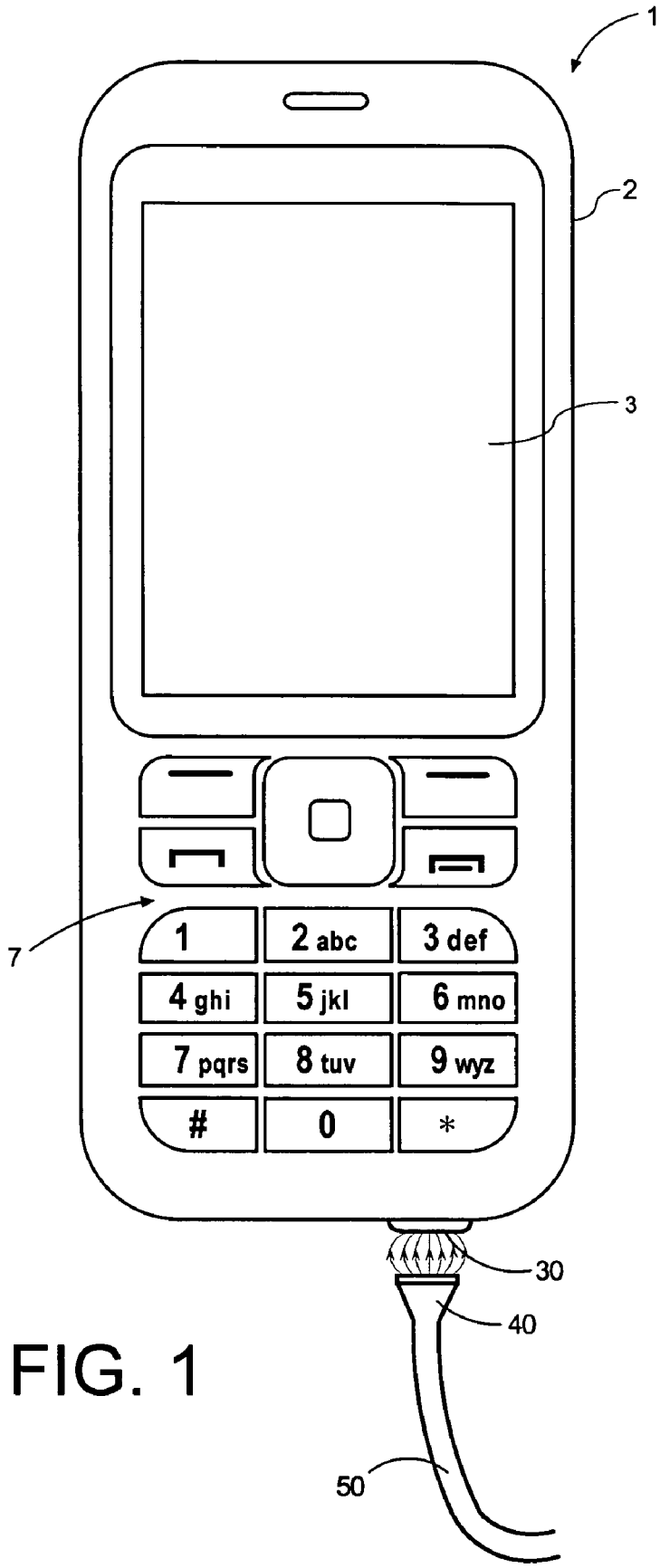
FIG. 1 is a front view of a mobile electronic device and a cable that are provided with a connector according to an embodiment of the invention.
Figure 2:
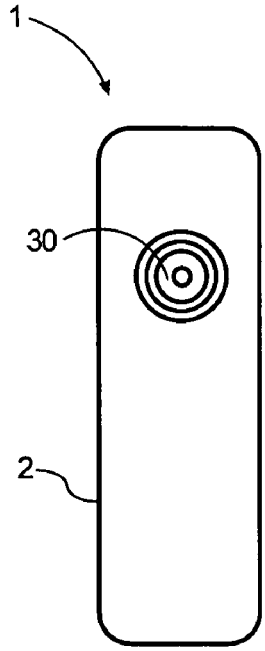
FIG. 2 is a bottom view of the mobile device according to FIG. 1.

FIGS. 1 and 2 illustrate a mobile phone 1 with a housing 2, a display 3 and a keypad 7. The type of mobile phone 1 that is illustrated is well-known in the art and therefore its operation and electronic components are not described in detail here.

A connector part 30 is disposed at the bottom of the mobile phone 1. A connector part 40 at the end of a cable 50 is disposed in the vicinity of the connector part 30. The cable 50 can be a cable that connects to a battery charger (not shown) or a cable that connects to earphones (not shown) or a cable that connects to a personal computer (not shown). The connector 40 could also be disposed of the end of other cables that can be used to connect to a mobile electronic device.

The connector part 30 and the connector part 40 are magnetically attracted to one another, which has been diagrammatically illustrated by the magnetic field lines in FIG. 1.

Figure 3:
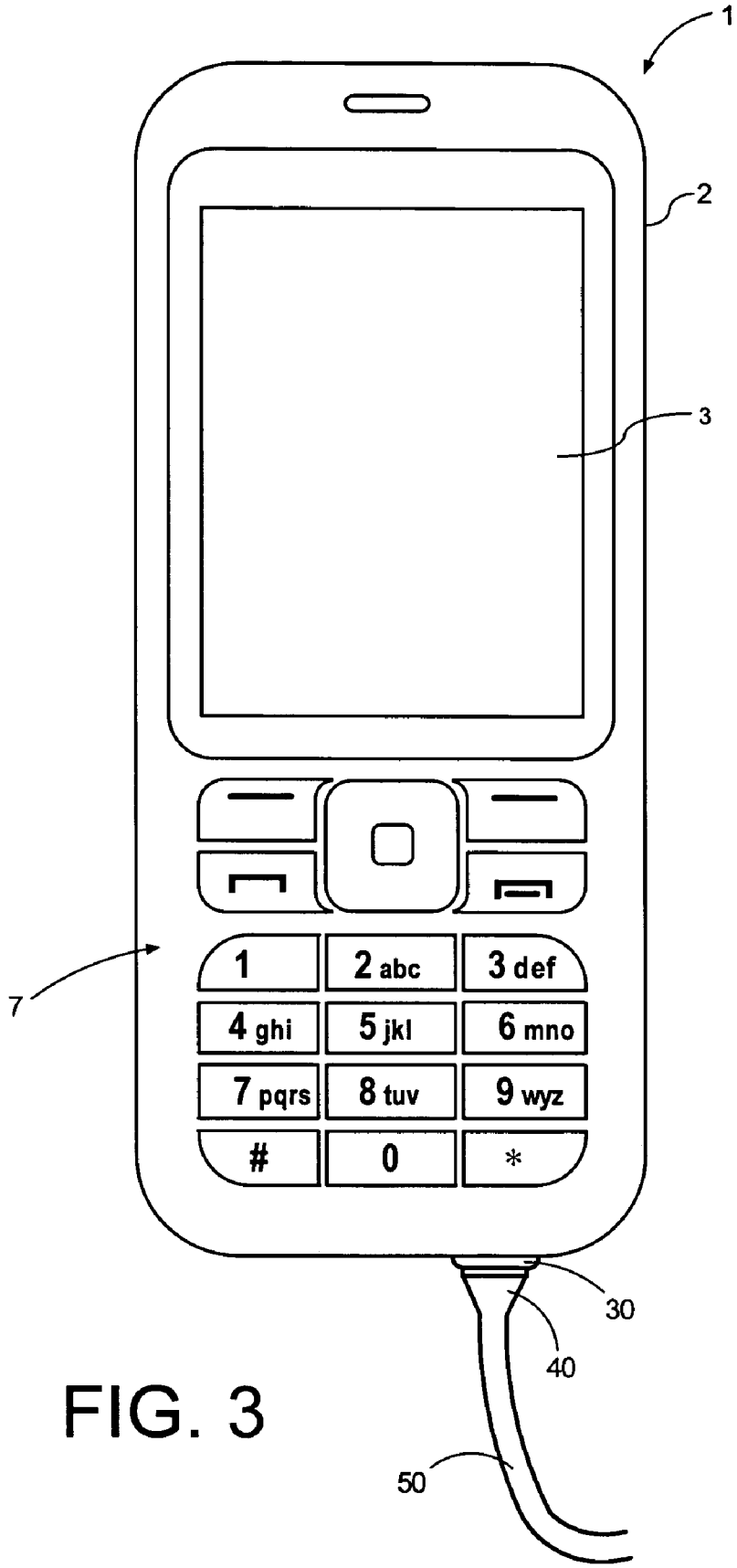
FIG. 3 is the same view as FIG. 1 with the cable connected to the mobile electronic device.

FIG. 3 shows the mobile phone 1 with the cable 50 connected thereto with the connection part 30 in magnetic engagement with the connection part 40. The magnetic attractive force in the engaged position is such that the cable 50 can be easily detached from the mobile phone 1 without exercising a substantial force on the mobile phone 1.

Figure 4:
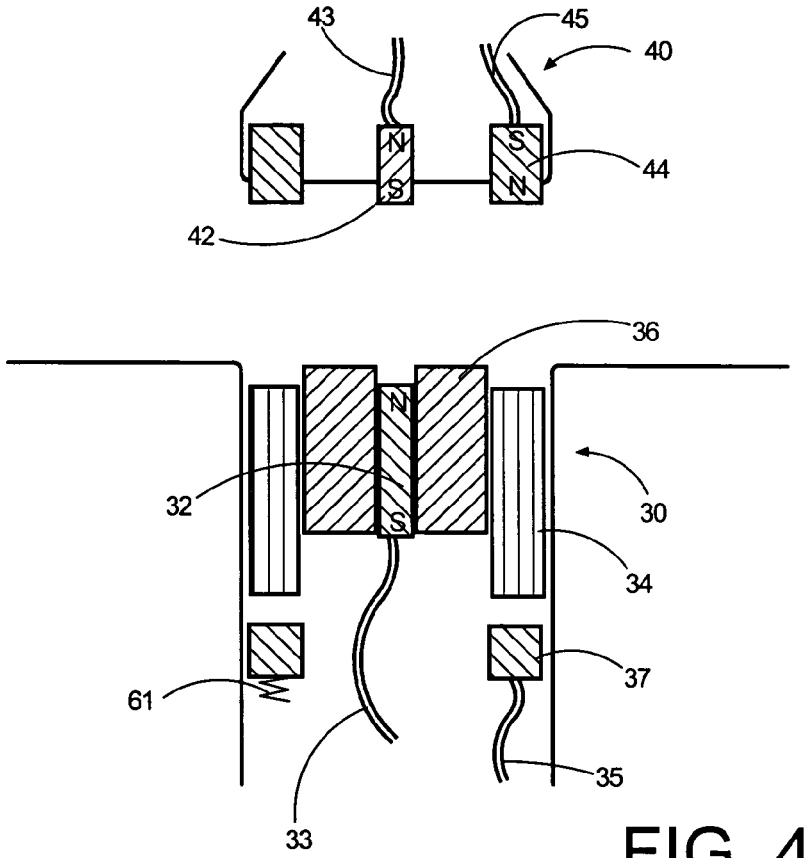
FIG. 4 is a cross-sectional view of a connector according to a first embodiment of the invention in a position in which the connector parts are not in engagement with one another.
Figure 5:
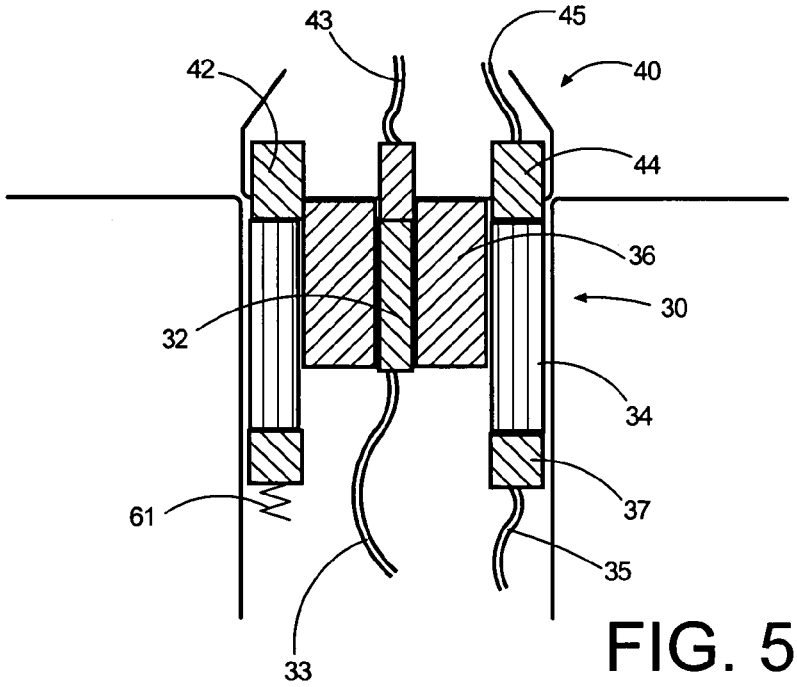
FIG. 5 is a cross-sectional view of the connector according to FIG. 4 with the connector parts in engagement.

FIGS. 4 and 5 illustrate the connector according to a first preferred embodiment of the invention. The connector part 40 comprises a (permanent) ring magnet 44 and a (permanent) bar magnet 42 that is positioned concentrically within the ring magnet 44. The bar magnet 42 may have a cylindrical shape so that it could be described as a rod-magnet. An electrical wire 43 is connected to the bar magnet 42 and another electrical wire 45 is connected to the ring magnet 44. In case the cable 50 that is attached to the connector part 40 is a charging cable, one of the electric wires will connect to a negative terminal and the other of the electrical wires will connect to a positive terminal. The magnetic north pole of the ring magnet 44 is disposed at the contact side of the connector part 40, whilst the magnetic south pole of the bar magnet 43 is disposed of the contact side of the connector part 40.

The connector part 40 is complementary with the connector part 30.

The connector part 30 includes a ring 34 of magnetic material, such as a ferrous material, and a permanent bar magnet 32 that is concentrically disposed inside the ring magnet 34. The bar magnet 32 is held in place inside the ring magnet by a hollow cylindrical bushing 36. The magnetic north pole of the bar magnet 32 is facing the contact side of the connector part 30. The connector part 30 also includes a resiliently suspended contact ring 37 of a magnetic material. The contact ring 37 is urged away from the ring 34 by a light spring 61.

The movable ring magnet 37 assumes a position in which it is not in contact with the ring 34 when the connector part 40 is not engaging the connector part 30. An electrical wire 33 is connected to the bar magnet 32 and an electrical wire 35 is connected to the ring contact 37.

The magnetism of the connector part 40 creates an attractive force to the magnetic material in the connector part 30. When the connector parts 30 and 40 are in engagement, the bar magnet 43 is in contact with the bar magnet 32 and an electrical connection is established between the electrical wire 43 and the electrical wire 33. Simultaneously, the ring magnet 44 is in contact with the ring 34. In this situation the ring 34 becomes magnetized and creates a magnetic attractive force between the ring 34 and the ring contact 37 that is strong enough to urge the ring contact 37 against the resilience force of the spring 61 into contact with the ring 34, thereby establishing an electrical connection between electrical wire 45 and electrical wire 35.

In a variation of the present embodiment, the electrical wires 43 and 45 can be connected to a battery charger (not shown), whilst the electrical wires 33 and 35 are connected electrical components (not shown) and the battery of the mobile phone 1.

According to a not shown alternative version of the embodiment of FIGS. 4 and 5 the electrical connection is established via dedicated electrodes. The electrical connection via the dedicated electrodes could be in addition to the electrical connection established via the magnets or the electrical connection via the dedicated electrodes could be the only electrical connection upon engaging the connector parts with one another.

Figure 6:
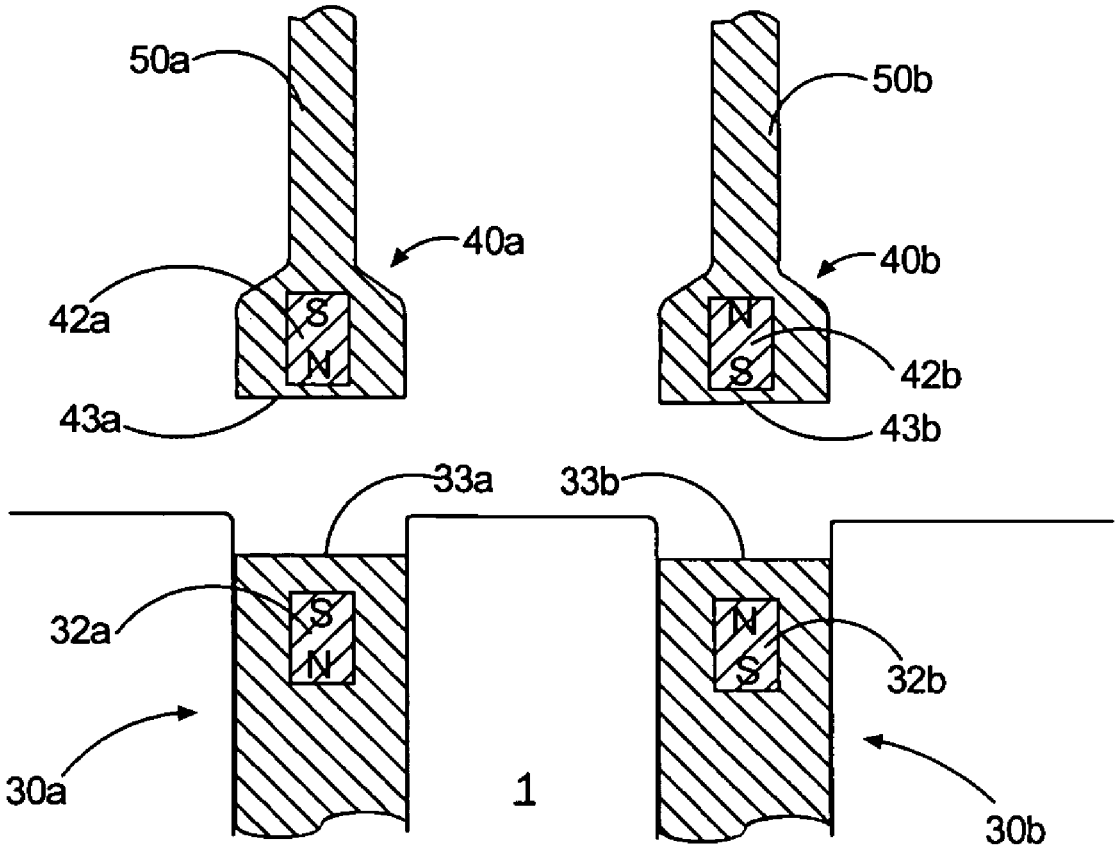
FIG. 6, is a cross-sectional view of a set of connectors to a second embodiment of the invention, FIG. 7 a cross-sectional view of a connector according to a third embodiment of the invention in a position in which the connector parts are not in engagement with one another.

FIG. 6 shows a second embodiment of the invention in which the mobile electric device 1 is provided with two connector parts. Connector part 30*a* includes a permanent bar magnet 32*b* that is oriented with its magnetic south pole towards its contact surface 33*a*. Connector part 30*b* includes a permanent bar magnet 32*b* that is oriented with its magnetic north pole towards its contact surface 33*b*. The contact surfaces 33*a* and 33*b* are provided with electrical contacts (not shown) which are connected to electrical wiring (not shown) leading to the electronic components inside the mobile electric device 1.

A cable 50*a* is provided at its end with a connector part 40*a*. Another cable 50*b* is provided at its end with a connector part 40*b*. The cables 50*a* and 50*b* are different cables with different functions such as for example a charging cable 50*a* and a cable 50*b* for connecting the mobile electric device 1 to a personal computer. The connector part 40*a* includes a bar magnet 42*a* that is oriented with its magnetic North Pole towards its contact surface 43*a*. The connector part 40*b* includes a bar magnet 42*b* that is oriented with its magnetic south pole towards its contact surface 43*b*.

The contact surfaces 43*a* and 43*c* are provided with electrical contacts (not shown) that are connected to electrical wires (not shown) in the respective cables 50*a* and 50*b*.

Due to the polarity arrangement connector part 40*b* is repulsed by connector part of 30*a* and connector part 40*a* is repulsed by connector part 30*b*. Thus, it is practically impossible to place the connector parts 40*a* and 40*b* on the wrong counterpart on the mobile electronic device 1. When the connector part 40*a* or 40*b* is brought in proximity with the correct counterpart 30*a* or 30*b* the magnetic attractive force between the permanent bar magnets will keep the respective connectors in engagement.

Figure 7:
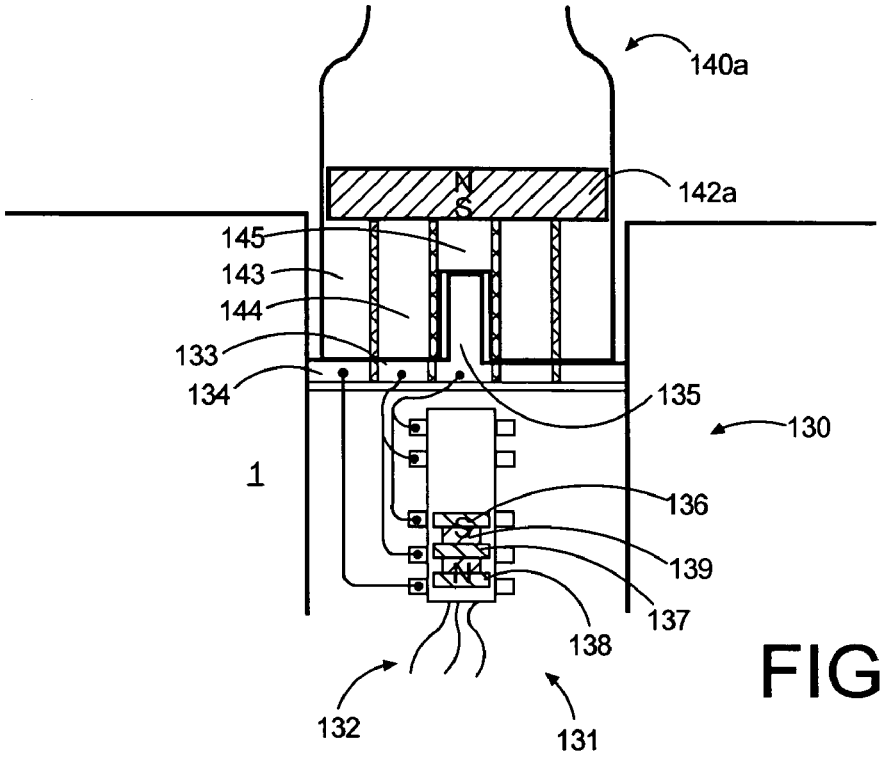
Figure 8:
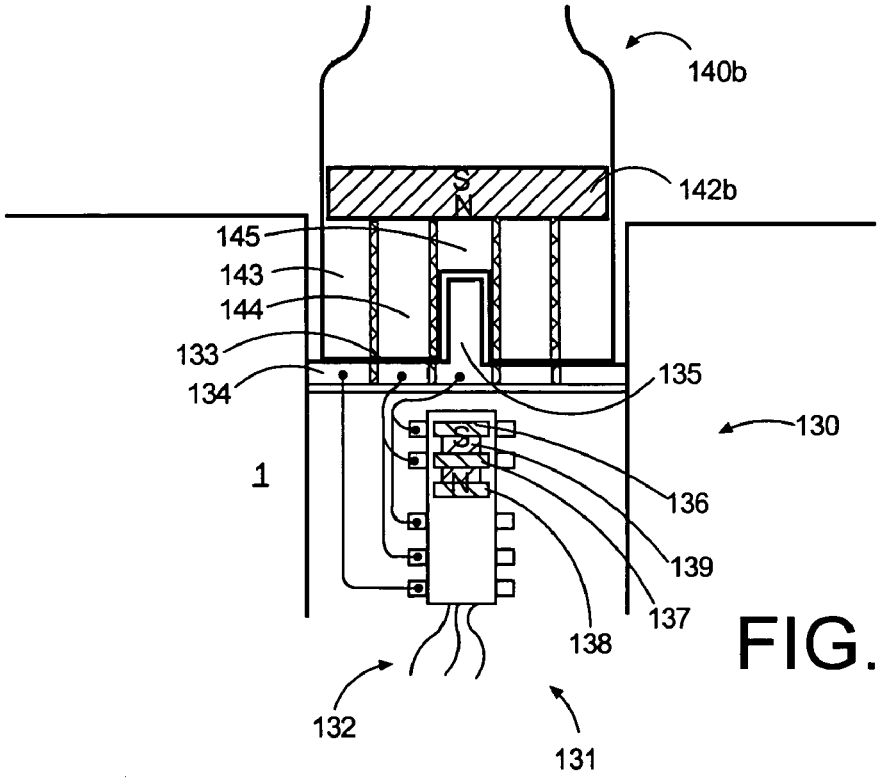
FIG. 8 is a cross-sectional view of the connector according to FIG. 7 in a position in which the connector parts are in engagement.

FIGS. 7 and 8 show a fourth embodiment of the connector according to the present invention. The connector includes a connector part 130 that is by way of example disposed in the mobile electronic device 1, and connector parts 140*a* and 140*b* that are by way of example connected to respective cables (not shown).

Connector part 140*a* includes a plate magnet 142*a* that is disposed in the connector part 140*a* with its magnetic south pole towards the contact side of the connector 140*a*. The connector 140*a* includes three concentrically disposed electrical contacts 143, 144 and 145, that are separated by insulating bushings. The electrical contact 145 is disposed at the bottom of a central cylindrical recess formed in the front surface of the connector. The recess serves to receive a cylindrical projection formed by electrical contact 135 that is protruding from the contact surface of the connector part 130.

The electrical contacts 143,144 and 145 are connected to wires (not shown) in the cable that is attached to the connector part 140.

Connector part 130 is provided with concentric ring contacts 133, 134 and 135. The contacts 133, 134 and 135 are made of magnetic material so that the contacts 143, 144 and 145 that are magnetized by the plate magnet 142*a* are magnetically attracted to the electrical contacts 133,134 and 135, thereby keeping the connector parts 140*a* and 130 in engagement. The electrical contacts 133, 134 and 135 are connected via respective wires to a magnetically operated switch 131.

A slidable permanent magnet 139 is disposed inside the magnetically operated switch 131 with its magnetic south pole towards the contact surface of the connector part 130. The slidable permanent magnet 139 is provided with three longitudinally spaced electrical contacts 136, 137 and 138. When the connector part 140*a* is placed in engagement with the connector part 130 the magnetic repulsive force between the plate magnet 142 and the slidable permanent magnet 139 that have their magnetic south poles facing one another causes the slidable permanent magnet 139 to be urged away from the connector part 140*a*.Thus, the slidable permanent magnet 139 assumes the "lower" position shown in FIG. 7, thereby establishing a first electric routing between the electric contacts 133, 134, 135 and the wiring 132 that connects the connector part 130 to the electronic components of the mobile electronic device 1.

Connector part 140*b* (FIG. 8) is substantially identical to connector part 140*a*, however the plate magnet 142*b* in the connector part 140*b* is disposed inside the connector part 140*b* with its magnetic north pole towards the contact side of the connector part 140*b*.

Thus, when the connector part 140*b* is in engagement with connector part 130 (FIG. 8) the magnetic attractive force between the plate magnet 142*b* and the slidable permanent magnet 139 urges the slidable permanent magnet 139 to move towards the connector 142*b*. Thus, the slidable permanent magnet 139 assumes the "upper" position shown in FIG. 8, thereby establishing a second electrical routing between the electric contacts 133, 134, 135 and the wiring 132 that connects the connector part 130 to the electronic components of the mobile electric device 1.

The type of electrical connection that is established between the mobile electronic device 1 and the external connector part that engages the connector part in the mobile electronic device 1 is controlled by the magnetic characteristics of the external connector part. Thus, visually and mechanically completely identical external connector parts can establish different electric connections. Thereby, it has become possible to use a mechanically and visually identical connector parts on different cables that are to be connected to the mobile electronic device. The connector part 140*a* could for example be placed at the end of a cable of a battery charger and the connector part 140*b* could for example be placed at the end of a cable for connecting the mobile electronic device to a personal computer. The magnetic differences between the connector parts ensure the proper connection with the electronic components of the mobile electronic device 1. This concept facilitates the use of the mobile electronic device, since the user can place the connector part of the different cables at one the same connector part on the mobile electronic device 1, and as there is no need to make a correct choice where to place the connector part that is attached to the cable onto the mobile electronic device 1. Further, having only a single connector part on the mobile electronic device has the advantage that it takes less space on the mobile electronic device.

Although the connectors according to the embodiments disclosed above have been described as rotation symmetrical (circular cross-section), it should be understood that these connectors do not need to be rotation symmetrical and could have any other suitable shaped cross-section, such as for example rectangular or triangular.

The term "comprising" as used in the claims does not exclude other elements or steps. The term "a" or "an" as used in the claims does not exclude a plurality. The reference signs used in the claims shall not be construed as limiting the scope.

Although the present invention has been described in detail for purpose of illustration, it is understood that such detail is solely for that purpose, and variations can be made therein by those skilled in the art without departing from the scope of the invention.

The invention claimed is:

1. A connector for electrically and mechanically connecting a cable to a mobile electronic device comprising a first connector part disposed at the end of the cable and a second connector part disposed at the mobile electric device, wherein at least one of said first and said second connector parts includes a magnet that is magnetically attracted to magnetic material disposed on the other of the at least one of said first and said second connector parts such that the magnetic force generated between the magnet and the magnetic material or between the two magnets is utilized for bringing the first connector part and the second connector part into engagement with each other thereby establishing an electrical connection between the cable and the mobile electrical device, and wherein the electrical connection is established by the magnet touching on the magnetic material.

2. The connector according to claim 1, wherein the second connector part includes a magnetically activated switch that assumes one condition when the first connector part is connected to the second connector part and another position when the first connector part is not connected to the second connector part.

3. The connector according to claim 2, wherein an electrical connection between the electronic device and the cable can only be established in the position that the magnetically activated switch assumes when the first connector part is connected to the second connector part.

4. The connector according to claim 1, wherein said second connector part can connect to a third connector part and when said second and/or said third connector part include a magnet that is magnetically attractive to magnetic material disposed on the other connector part.

5. The connector according to claim 4, wherein a first electric routing is established when said second connector part is connected to said first connector part and wherein a second electric routing different from the first electric routing is established when said second connector part is connected to set third connector part.

6. The connector according to claim 5, wherein said different routing is established by a magnetic switch connected to said second connector part and said magnetic switch assuming the first position when said first connector part is connected to said second connector part and said magnetic switch assuming a second position when said second connector part is connected to set third connector part.

7. The connector according to claim 1 wherein the first connector part is connected to a housing of a mobile electronic device.

8. The connector according to claim 1 further comprising:

a third connector part arranged on said first connector part; and a fourth connector part on said second connector part;

wherein said first connector part is arranged to attract said second connector part and to repulse said fourth connector part, and wherein said third connector part is arranged to attract said fourth connector part and to repulse said second connector part.

9. The connector according to claim 7, wherein said mobile electronic device is a mobile phone.

10. The connector according to claim 7, wherein said mobile electronic device is a battery charger.

11. The connector according to claim 10, further comprising a cable, wherein one end of the cable is coupled to said charger and the other end of said cable is attached to said connector part.

12. The connector according to claim 1 wherein the first connector part and/or the second connector part is connected to an electrical conductor of a cable.

* * * * *